US010486035B2

(12) United States Patent
Vanderpols

(10) Patent No.: US 10,486,035 B2
(45) Date of Patent: Nov. 26, 2019

(54) RACQUET STRINGING MACHINE

(71) Applicant: ELDING IND. CO., LTD., Taichung (TW)

(72) Inventor: Erik Bernard Vanderpols, Taichung (TW)

(73) Assignee: Elding Ind. Co., Ltd., Taichung (TW)

( * ) Notice: Subject to any disclaimer, the term of this patent is extended or adjusted under 35 U.S.C. 154(b) by 0 days.

(21) Appl. No.: 16/249,090

(22) Filed: Jan. 16, 2019

(65) Prior Publication Data

US 2019/0275380 A1 Sep. 12, 2019

(30) Foreign Application Priority Data

Mar. 9, 2018 (TW) ..... 107108119 A

(51) Int. Cl.
*A63B 51/14* (2006.01)

(52) U.S. Cl.
CPC ..... *A63B 51/14* (2013.01)

(58) Field of Classification Search
CPC ..... A63B 51/12; A63B 51/14; A63B 51/16
See application file for complete search history.

(56) References Cited

U.S. PATENT DOCUMENTS

| | | | | |
|---|---|---|---|---|
| 5,026,055 | A * | 6/1991 | Longeat | A63B 51/14 473/556 |
| 2005/0096160 | A1* | 5/2005 | Nakane | A63B 51/14 473/557 |
| 2015/0133243 | A1* | 5/2015 | Zdrazila | A63B 51/16 473/556 |
| 2016/0121175 | A1* | 5/2016 | Cerf | A63B 51/14 473/555 |
| 2016/0121176 | A1* | 5/2016 | Cerf | A63B 51/14 473/557 |
| 2017/0080298 | A1* | 3/2017 | Yadav | A63B 24/00 |

* cited by examiner

*Primary Examiner* — Raleigh W Chiu
(74) *Attorney, Agent, or Firm* — Thomas J. Nikolai; DeWitt LLP

(57) ABSTRACT

A racquet stringing machine includes a base, a clamp device for clamping a racquet frame, and a string pulling device. The clamp device has a turntable and a clamping portion. The turntable includes a rotating shaft pivotally connected to the base. The clamping portion is fixed on the turntable. The string pulling device is disposed at one side of the clamp device for tightening a string passing through the racquet frame and rotating the turntable according to a threading position. The base is provided with a sensing unit electrically connected to the string pulling device for sensing the present threading position of the string and for generating a control signal to control the string pulling device to pull the string.

2 Claims, 7 Drawing Sheets

RACQUET STRINGING MACHINE

FIELD OF THE INVENTION

The present invention relates to a production apparatus for a racquet, and more particularly to a racquet stringing machine.

BACKGROUND OF THE INVENTION

A badminton racquet, a tennis racquet and the like have a plurality of strings fixed on a racquet frame in a cross manner, thereby forming a mesh structure for hitting a badminton or tennis ball. The string is threaded on the racquet frame with different tensions, which will affect the elasticity of the string and thus change the performance of hitting the ball. Advance preparation is important. If the tension of the string is planned and designed properly, it will enhance the stability of controlling the ball and improve the speed of hitting the ball. It is beneficial for athletes to score well. According to the research, the racquet defines three preferred positions for hitting the ball, which can minimize the impact force transmitted to the hand after hitting the ball, minimize the vibration making the palm and the arm uncomfortable, and maximize the speed or force at which the ball is struck. In order to achieve the best result for the three hitting positions, the tension of each string on the racquet is different.

A conventional racquet stringing machine, as disclosed in Taiwan Utility Model Publication No. M544958, includes a racquet frame clamp device and a string pulling device. The string pulling device moves in a straight direction to tighten the string. The tension of the string is determined by the displacement of the string pulling device. However, the conventional racquet stringing machine is manual operated to thread only one of the positions of the racquet frame during one threading process. Since the racquet stringing machine does not have the ability to identify the current threading position, the operator must do it himself and then pull the string for the required tension at the position, resulting in low production efficiency.

Accordingly, the inventor of the present invention has devoted himself based on his many years of practical experiences to solve these problems.

SUMMARY OF THE INVENTION

The primary object of the present invention is to provide a racquet stringing machine that can automatically detect the present threading position of the string for controlling a string pulling device to pull the string.

In order to achieve the aforesaid object, a racquet stringing machine provided by the present invention comprises a base, a clamp device for clamping a racquet frame, a string pulling device, and a sensing unit. The clamp device has a turntable and a clamping portion. The turntable includes a rotating shaft pivotally connected to the base. The clamping portion is fixed on the turntable. The string pulling device is disposed at one side of the clamp device for tightening a string passing through the racquet frame. When the string is tightened, the turntable drives the rotating shaft to generate different degrees of rotation according to a threading position of the string on the racquet frame. The sensing unit is electrically connected to the string pulling device for sensing the present threading position of the string according to rotation of the turntable or the racquet frame and for generating a control signal to control the string pulling device to pull the string.

In an embodiment, the sensing unit includes a rotary encoder surrounding the rotating shaft for measuring an angular displacement of the rotation of the rotating shaft to be converted into the present threading position of the string.

In an embodiment, the sensing unit includes a direction sensor or a gyro sensor disposed on the racquet frame for measuring the amount of change in the direction of the racquet frame with the rotation of the rotating shaft to be converted into the present threading position of the string.

In an embodiment, the sensing unit includes an image capturing unit for taking an image of the racquet frame and comparing it with a previous captured image to be converted into the current threading position of the string.

DETAILED DESCRIPTION OF THE PREFERRED EMBODIMENTS

Embodiments of the present invention will now be described, by way of example only, with reference to the accompanying drawings.

Figure 1:
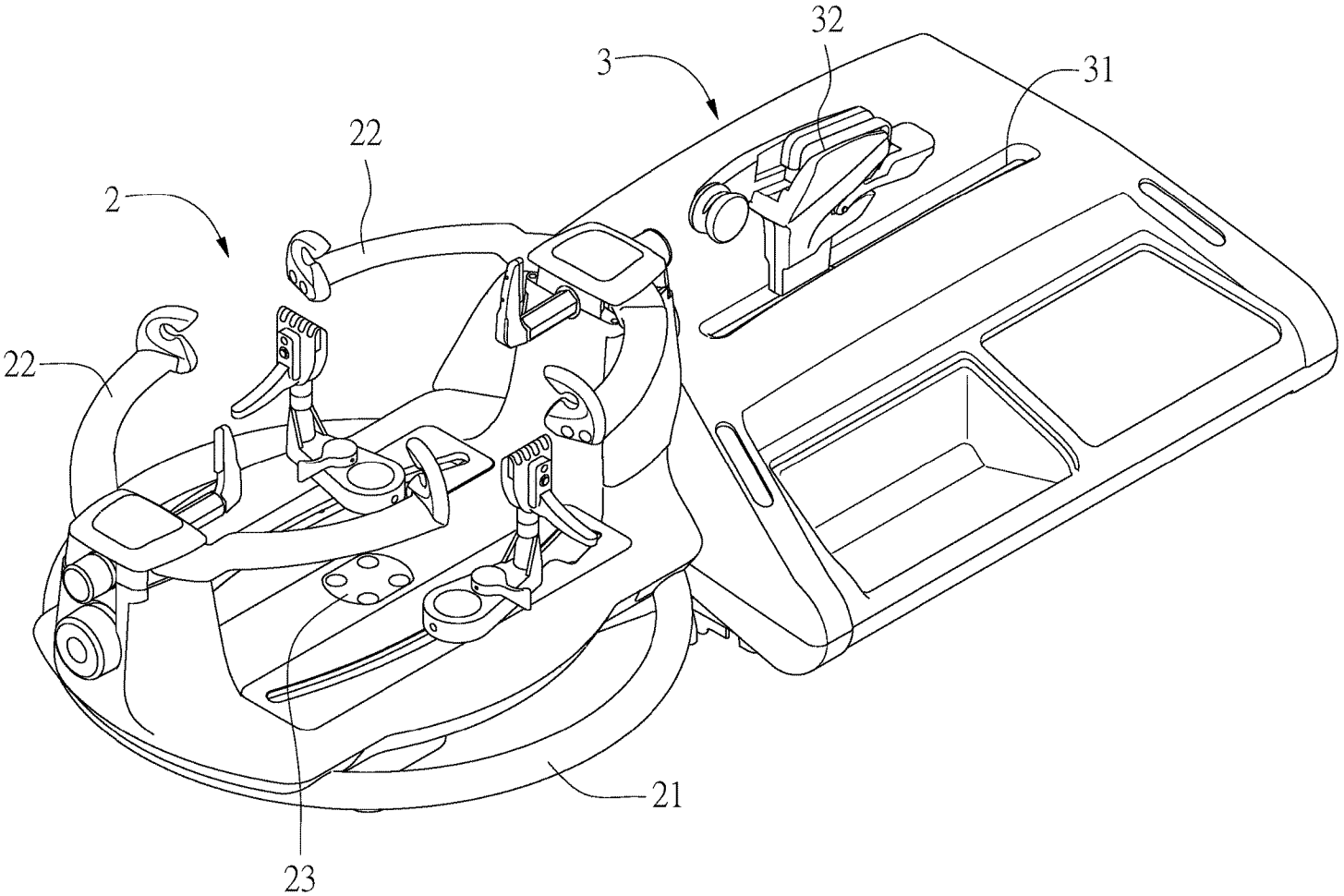
FIG. 1 is a perspective view in accordance with a first embodiment of the present invention.
Figure 2:
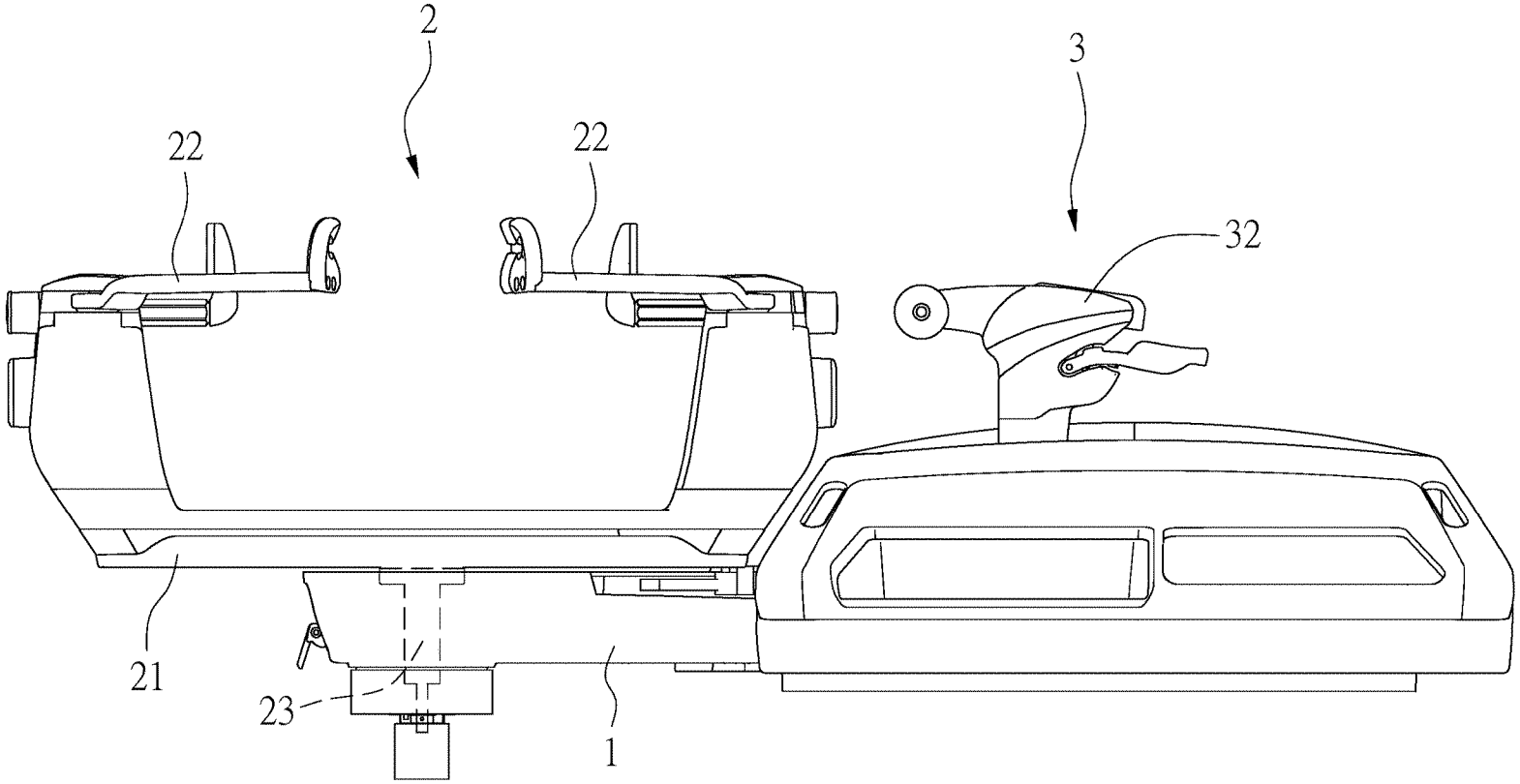
FIG. 2 is a side view in accordance with the first embodiment of the present invention.

Referring to FIG. 1 and FIG. 2, a racquet stringing machine in accordance with a first embodiment of the present invention comprises a base 1, a clamp device 2 for clamping a racquet frame, and a string pulling device 3. The clamp device 2 and the string pulling device 3 are disposed on the base 1. The string pulling device 3 is located at one side of the clamp device 2. The clamp device 2 includes a turntable 21 and a clamping portion 22 for clamping the racquet frame. The clamping portion 22 is fixed on the turntable 21. A rotating shaft 23 extends downward from the center of the turntable 21. The rotating shaft 23 is pivotally connected to the base 1, so that the rotating shaft 23 is rotatable relative to the base 1 with the rotating shaft 23 as an axis. The string pulling device 3 is provided with a long slide slot 31 extending away from the clamp device 2. The long slide slot 31 is provided with a displacement member 32 for controlling the string. The string is threaded on the racquet frame. The displacement member 32 is movable along the long slide slot 31 to tighten the string. Tension of the string is determined according to the amount of displacement of the displacement member 32.

Figure 4:
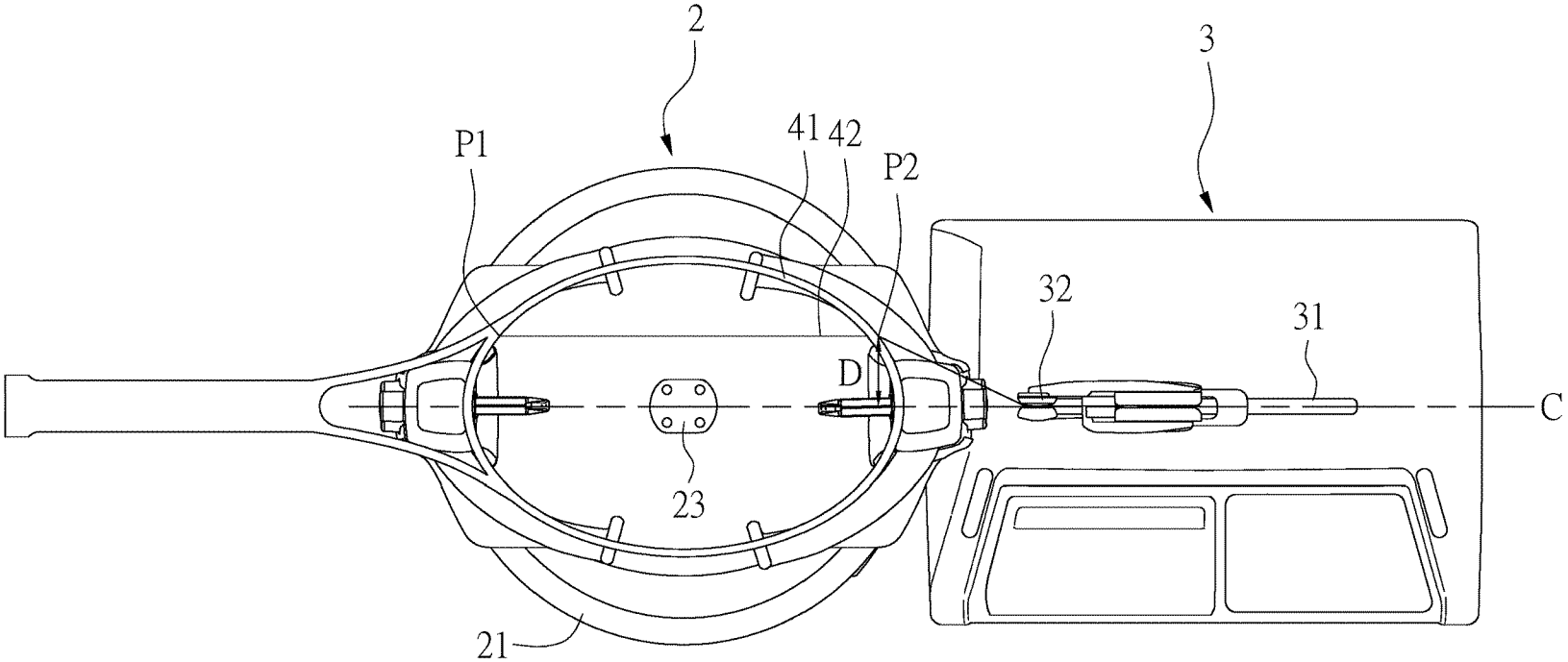
FIG. 4 and FIG. 5 are schematic views of the first or second embodiment of the present invention when in use.
Figure 5:
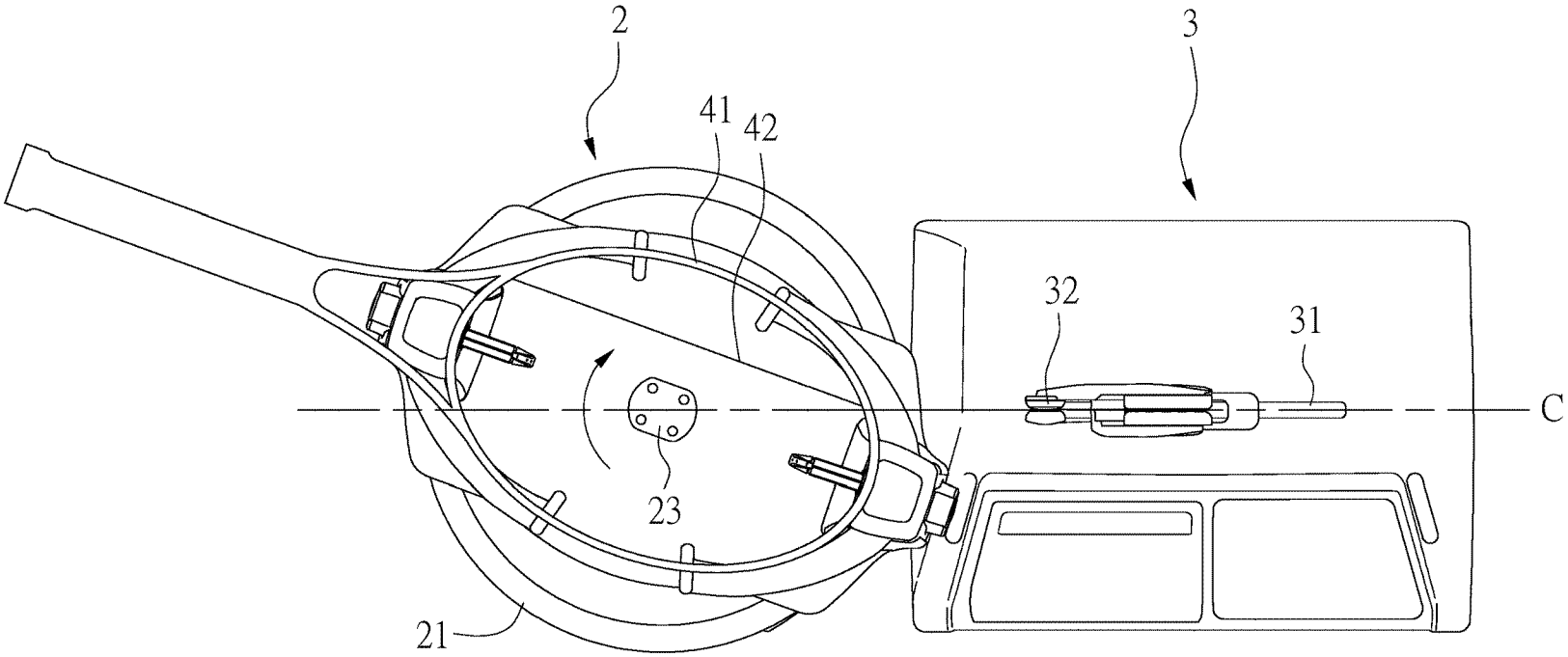

As shown in FIG. 4, a virtual axis C extending along the long slide slot 31 is defined, and the rotating shaft 23 is located on the virtual axis C. Accordingly, when the string 42 pulled by the string pulling device 3 is tightened, the threading position on the racquet frame 41 is not located on the virtual axis C, such as the threading points P1, P2 (the two are located at symmetrical positions on the racquet frame 41) as shown in FIG. 4, the turntable 21 will be pulled by the string 42, as shown in FIG. 5, to rotate relative to the base 1 through the rotating shaft 23. The angular displacement of the turntable 21 is determined by the vertical distance D from the string 42 passing through the points P1, P2 to the virtual axis C. In other words, the longer the vertical distance D from the string 42 passing through the points P1, P2 to the virtual axis C, the greater the angular displacement of the turntable 21 being pulled.

Figure 3:
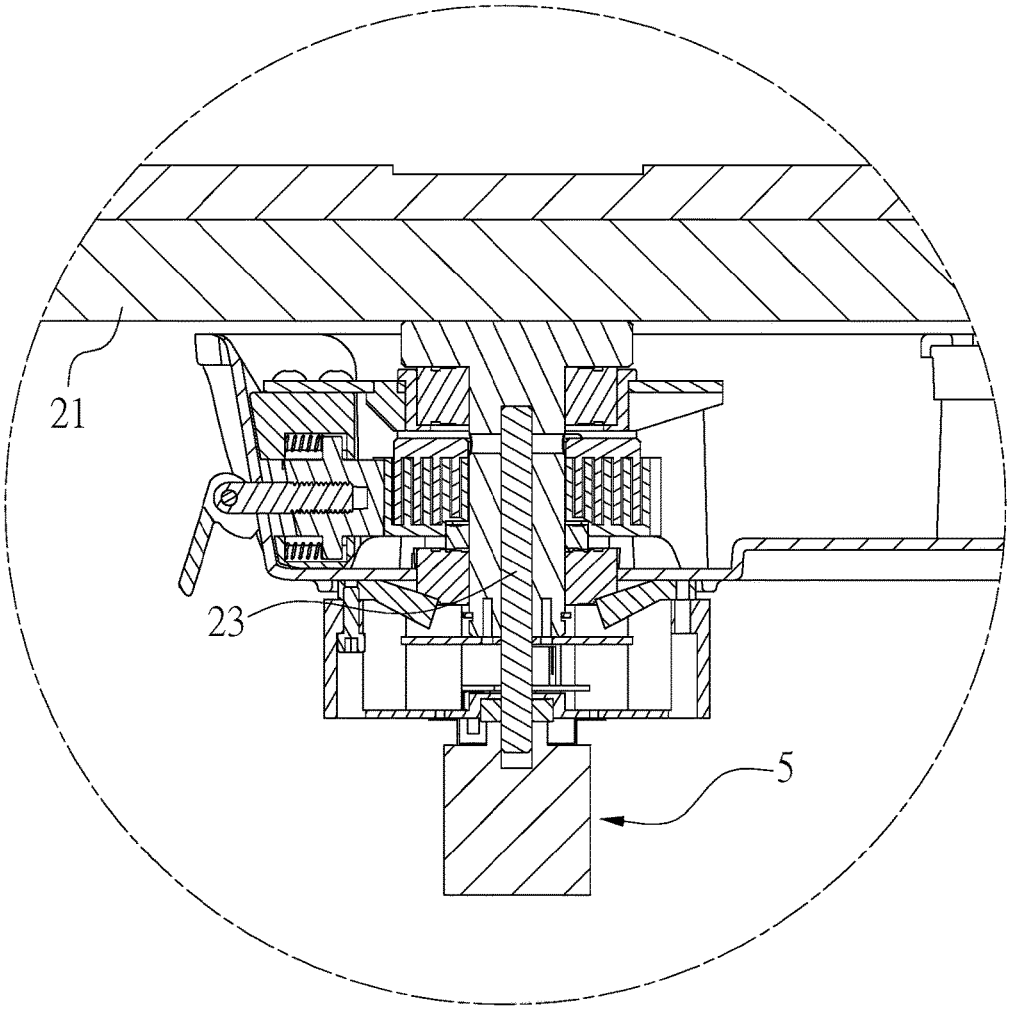
FIG. 3 is a partial sectional side view in accordance with the first embodiment of the present invention.

The invention utilizes a sensing unit to sense the present threading position of the string and generate a control signal to control the string pulling device to pull the string. In this embodiment, as shown in FIG. 3, the sensing unit has a rotary encoder 5 that surrounds the rotating shaft 23 and is electrically connected to the string pulling device. The rotary encoder 5 can measure the angular displacement of the rotation of the rotating shaft 23, that is, the rotational amplitude of the turntable 21, by means of various conventional identification methods. Since the threading position of the string on the racquet frame has a unique correspondence with the amount of rotation of the turntable 21, the corresponding threading position of the string can be obtained by converting the amount of rotation of the turntable 21, and a control signal is generated and transmitted to the string pulling device for controlling the string to be pulled.

With the above structure, the present invention can automatically identify the threading position of the string 42 through the rotational angular displacement of the turntable 21 detected by the rotary encoder when the string pulling device 3 pulls the string 42 to the state shown in FIG. 5, thereby controlling the string pulling device 3 to pull the string.

Figure 6:
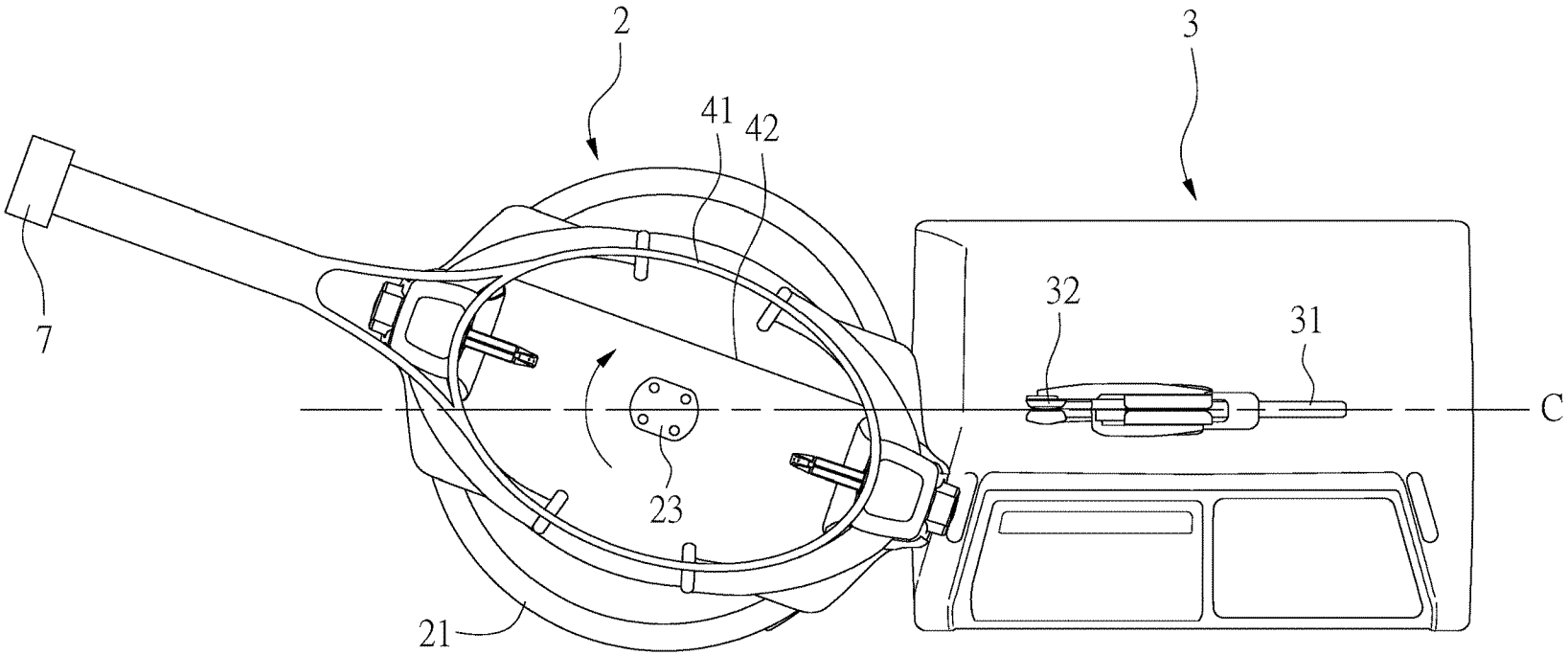
FIG. 6 is a schematic view of the second embodiment of the present invention when in use.

The present invention further provides a second embodiment. The second embodiment is based on the structure of the first embodiment described above. Wherein, the sensing unit is implemented by a direction sensor or a gyro sensor 7. In the embodiment, as shown in FIG. 6, the direction sensor or the gyro sensor 7 is disposed on the racquet frame 41. When the string 42 is pulled to rotate the racquet frame 41, the direction sensor or the gyro sensor 7 senses the amount of change in the direction of the racquet frame 41. Similarly, since the threading position of the string 42 on the racquet frame 41 has a unique correspondence with the amount of change in direction after the racquet frame 41 is rotated, the corresponding threading position of the string 42 can be obtained by converting the amount of change in the direction of the racquet frame 41, and a control signal is generated and transmitted to the string pulling device 3 for controlling the string to be pulled.

Figure 7:
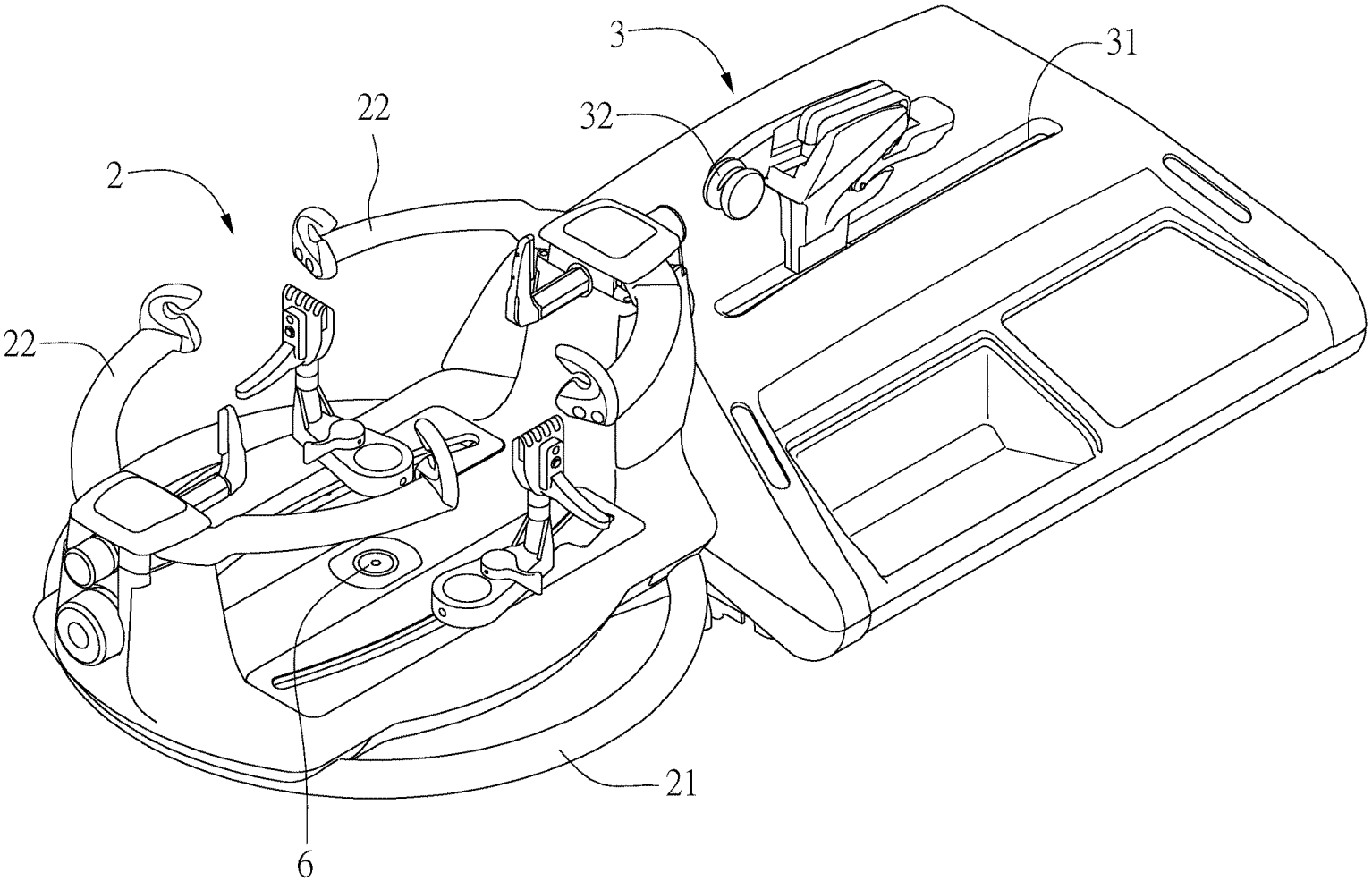
FIG. 7 is a perspective view in accordance with a third embodiment of the present invention.

FIG. 7 illustrates a third embodiment of the present invention. The third embodiment is based on the structure of the foregoing first embodiment. Wherein, the sensing unit is implemented by an image capturing unit 6. In the embodiment, the image capturing unit 6 is disposed on the turntable for taking an image of the racquet frame upwards, including information such as the position and number of the string on the racquet frame.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A racquet stringing machine, comprising:

a base;

a clamp device for clamping a racquet frame, having a turntable and a clamping portion, the turntable including a rotating shaft pivotally connected to the base, the clamping portion being fixed on the turntable;

a string pulling device, disposed at one side of the clamp device for tightening a string passing through the racquet frame, the turntable being driven by a tightened string to generate a rotation together with the rotating shaft and the racquet frame according to a threading position of the string on the racquet frame;

a sensing unit including a rotary encoder surrounding the rotating shaft, electrically connected to the string pulling device for measuring an angular displacement of the rotation of the rotating shaft and sensing a present threading position of the string according to the rotation of the turntable or the racquet frame and for generating a control signal to control the string pulling device to pull the string.

2. A racquet stringing machine, comprising:

a base;

a clamp device for clamping a racquet frame, having a turntable and a clamping portion, the turntable including a rotating shaft pivotally connected to the base, the clamping portion being fixed on the turntable;

a string pulling device, disposed at one side of the clamp device for tightening a string passing through the racquet frame, the turntable being driven by a tightened string to generate a rotation together with the rotating shaft and the racquet frame according to a threading position of the string on the racquet frame;

a sensing unit, electrically connected to the string pulling device for sensing a present threading position of the string according to the rotation of the turntable or the racquet frame, said sensing unit including a direction sensor or a gyro sensor to be disposed on the racquet frame for measuring an amount of change in the direction of the racquet frame to be converted into the present threading position of the string and for generating a control signal to control the string pulling device to pull the string.

* * * * *